United States Patent [19]

Jaye

[11] 4,325,059

[45] Apr. 13, 1982

[54] SENSOR FOR DETECTING DELETERIOUS CONDITIONS

[76] Inventor: Richard C. Jaye, 12 Brian Ct., Watertown, Wis. 53094

[21] Appl. No.: 214,198

[22] Filed: Dec. 8, 1980

[51] Int. Cl.[3] ..... G08B 21/00; H01H 37/75

[52] U.S. Cl. ..... 340/585; 200/61.83; 340/590

[58] Field of Search ..... 340/585, 590; 200/61.83; 116/106

[56] References Cited

U.S. PATENT DOCUMENTS

| | | | |
|---|---|---|---|
| 213,536 | 3/1879 | Vander Weyde | 340/590 |
| 3,896,278 | 7/1975 | Murawski et al. | 200/61.83 |
| 4,011,552 | 3/1977 | Quirke | 340/585 |
| 4,144,532 | 3/1979 | Boyd | 340/585 |

*Primary Examiner*—Glen R. Swann, III

*Attorney, Agent, or Firm*—James R. Custin

[57] ABSTRACT

A freezer alarm sensor has a body in which there is an elongated vertically extending chamber. Contactors connectable in an alarm energizing circuit, normally insulated from one another, are exposed in the chamber, near one of its ends and diametrically opposite one another. A current conducting slider is freely slidable in the chamber between a raised position spaced from the contactors and a dropped position engaging the contactors and electrically connecting them. The chamber is partially filled with material that is solid at temperatures below a predetermined value and by which the slider is bound to the body and thus held in its raised position, but said material melts at temperatures above that value, releasing the slider to fall to its dropped position. Also disclosed are a heat sensor and a flood sensor embodying principles of the invention.

7 Claims, 6 Drawing Figures

SENSOR FOR DETECTING DELETERIOUS CONDITIONS

FIELD OF THE INVENTION

This invention relates to alarm system sensors for responding to a deleterious condition, such as overtemperature sensors for food freezer alarm systems and heat alarm systems; and the invention is more particularly concerned with a simple, inexpensive overtemperature sensor which draws no current at times when sensed temperatures are within a normal range, which is nonresponsive to transient temperature rises, but which responds reliably if an overtemperature persists for a significant time period.

RELATED APPLICATION

The applicant's copending application, U.S. Ser. No. 153,155, filed May 27, 1980, entitled "Alarm Sensor Responsive to Deleterious Conditions," is concerned with generally related subject matter.

BACKGROUND OF THE INVENTION

As brought out in the above-mentioned copending application, numerous alarm systems have been developed for signaling a deleterious condition such as an overtemperature. In most cases the component of such a system that has caused the most difficulty and expense has been the sensor that responds to the condition to be detected and triggers operation of the device that emits the perceptible alarm signal.

A food freezer alarm sensor poses a particularly difficult problem. Such a sensor must respond to a rise in freezer cabinet temperature to above a predetermined value, but on the other hand it should set off the alarm only when an overtemperature condition has persisted for a significant length of time, instead of responding to merely transient temperature rises such as are due to opening of the freezer cabinet door or normal operation of the automatic defrosting cycle. A successful freezer alarm sensor which meets these requirements is disclosed in U.S. Pat. No. 4,011,552, to P. C. Quirke, but the sensor disclosed in that patent is relatively expensive to produce and its thermally responsive element responds with only a small change in current flow when temperature rises above the critical value, thus making necessary a small amplifier which further increases the cost of an alarm system incorporating that sensor.

The above identified copending application discloses a sensor which is adaptable to freezer alarm systems but which requires the preparation of a frozen pellet or tablet to render it suitable for such applications. Such preparation involves an element of substantial inconvenience that considerably offsets the low cost and reliability of the device.

SUMMARY OF THE INVENTION

The general object of the present invention is to provide a sensor for response to a predetermined deleterious condition such as an overtemperature or the presence of water, which sensor is simple, sturdy, reliable and inexpensive, draws no current when satisfactory conditions prevail, and requires no amplifier to supplement it in setting off an alarm with which it is connected.

A more specific object of the invention is to provide a completely self-contained overtemperature sensor for food freezer cabinets that is non-responsive to transient overtemperatures that occur as a result of opening the cabinet door or normal automatic defrosting but is nevertheless fully responsive to the persistence for a significant time of a temperature in excess of a predetermined value.

It is also a specific object of this invention to provide a self-contained overtemperature sensor that is especially well suited for food freezers by reason of simplicity, compactness, low cost, reliability, and the absence of materials and components that could contaminate food in a freezer.

Although the present invention is regarded as particularly advantageous as embodied in a food freezer, it will be apparent that the principles of the invention are well adapted to application in other types of overtemperature sensing devices, and the principles of the invention are also applicable to sensors for other deleterious conditions such as the presence of over-flow water.

In general, the objects of the invention are achieved in a sensor of the character described that comprises a body in which there is a well and which can be supported with the axis of said well extending substantially vertically; contact means on said body connectable in an electrical energizing circuit for an alarm signaling device and comprising a pair of contacts that are exposed at spaced apart locations and are normally electrically insulated from one another; a slider guided in said well for up and down motion relative to the body and having a current conducting contact portion that is engaged with both of said contacts when the slider is in a dropped position, to provide an electrical connection between said contacts; and said body and said slider being arranged for cooperation with a quantity of a material which is normally solid and which engages the slider to support it in a raised position in which its contact portion is spaced from at least one of said contacts, said material being capable of disintegrating in the presence of a deleterious condition to be sensed, to release the slider for fall to its dropped position.

In the case of a freezer alarm sensor, the well in the body is closed at both ends, the contactors are exposed in the well at opposite sides of its axis to be bridged by the slider, and said material partially fills the well and is solid below a predetermined temperature and liquid above that temperature.

BRIEF DESCRIPTION OF DRAWINGS

In the accompanying drawings, which illustrate what are now regarded as preferred embodiments of the invention.

DETAILED DESCRIPTION OF PREFERRED EMBODIMENT OF THE INVENTION

Figure 1:
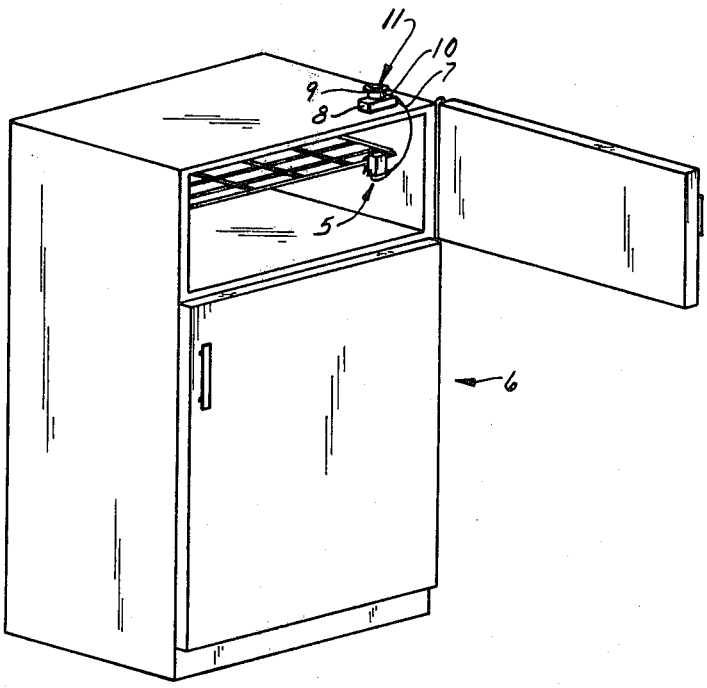
FIG. 1 is a perspective view of a food freezer in which there is installed an overtemperature alarm system comprising a sensor of this invention.

As incorporated in a freezer alarm system, a sensor 5 of this invention will normally be placed inside a food freezer cabinet 6 and will be connected by wires 7 with a battery 8 and a signal device 9. The signal device 9 can be a small horn of a known type that emits a very penetrating sound when energized with current from the battery 8. The signal device 9 and a housing or case 10 for the battery 8 can be fastened together and electrically connected to form a compact modular unit 11 that can rest on top of the freezer cabinet or can be mounted at any other suitable location that is preferably external to the freezer.

The sensor 5 of this invention comprises a body 15 in which there is a blind bore 16 that defines a well or elongated chamber wherein a slider or plunger 17 is freely slidable. A pair of electrical conductor elements 18 are fixed to the body 15 and are accessible at its exterior for connection in the electrical circuit for the signal device 9. Each of the conductor elements 18 comprises a contactor 19 that is exposed in the interior of the chamber 16, near one end thereof, said contactors 18 being in spaced relationship to one another. Because the body 15 is made of an electrically non-conductive material such as acrylic plastic, the contactors 18 are normally in electrically insulated relation to one another, but the slider 17, when in its dropped position shown in FIG. 4, electrically connects the contactors to close the energizing circuit in which they are connected.

The body 15 can have any desired shape, but desirably it should occupy a minimum of freezer space and therefore it is preferably block-like and elongated, as shown, with the bore 16 drilled into it lengthwise from one of its ends and closed by a sealing plug 20 that is cemented in place. The plug 20 can comprise a small disc of the same material as the body, snugly received in a shallow counterbore at the mouth of the bore. The body 15 has flat end surfaces 21 that are normal to the axis of the bore 16 so that it can rest on either of those end surfaces with the bore 16 extending substantially vertically and with either end of the bore uppermost. The end of the well or chamber 16 near which the contactors 19 are located is hereinafter referred to as the bottom end thereof, but it will be seen that it is so designated merely for purposes of identification and not by way of description.

As shown, the two conductor elements 18 comprise screws that are threaded into the body from opposite sides thereof and have their tip portions projecting into the bore diametrically opposite one another to provide the spaced apart contactors 19. The heads of the screws provide securement for conventional electrical terminal connectors 22 on the wires 7 that extend to the modular unit 11.

The slider or plunger 17 is preferably made as one piece of metal and is heavy enough so that its own weight can readily propel it along the bore 16 as the body 15 is upended first one way and then the other. It will be evident that the electrically conductive slider 17 cooperates with the conductor elements 18 to provide a switch that is closed when the slider is in contacting relation with the two spaced apart contacts 19. To ensure that the slider 17 can make good electrical contact with the contactors 19, it has a conical lower contact portion 24 that converges downwardly from a cylindrical upper portion 25. The diameter of its upper portion 25 is such that the slider has a fairly close but free sliding fit in the bore 16. As the slider falls along the bore 16, its frustoconical bottom portion tends to wedge itself between the contactors 19, ensuring good circuit-making engagement with them, but the taper on the lower portion 24 of the slider is sufficiently abrupt so that the slider does not jam between the contactors 19 and can very readily fall away from them when the body 15 is inverted.

Figure 4:
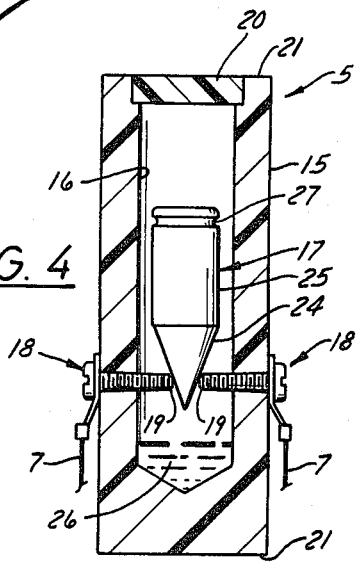
FIG. 4 is a view generally similar to FIG. 3 but showing the sensor in its dropped or alarm-triggering condition.

In addition to the slider 17 there is sealed into the chamber 16 a quantity of a material 26 that is liquid at temperatures above a predetermined value (e.g., 20° F. (−7° C.) in the case of a freezer sensor) but which is in the solid state at temperatures below that value. The amount of such material in the chamber can be rather small, so that—as shown in FIG. 4—when the material is in its liquid state and the body is in its normal orientation, the material 26 fills only the bottom end portion of the chamber, to a level below the contactors 19.

To prepare the sensor 5 for operation, it is placed in a normally operating freezer with its bottom end uppermost. In that orientation the slider 17 is in the nominal upper end of the chamber 16 and is surrounded by the material 26. After the sensor has been in the freezer for a few hours, the material 26 will be frozen and will securely bind the slider 17 to the body 15. To ensure against movement of the slider 17 in the body while the material 26 remains frozen, the slider can have at least one circumferential groove 27 in its cylindrical upper portion, to define a radially outwardly opening recess into which the frozen material projects.

Figure 3:
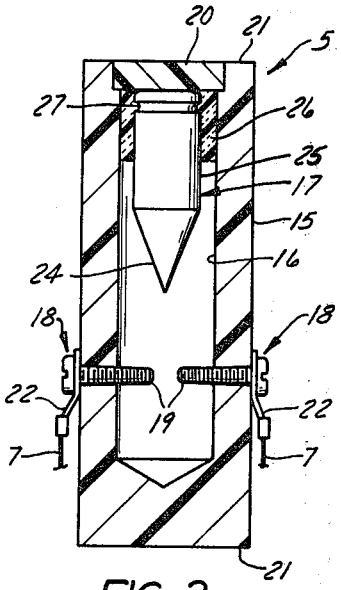
FIG. 3 is a view of the sensor in longitudinal section, taken on the plane of the line 3—3 in FIG. 2, with the sensor shown in its normal condition.
Figure 2:
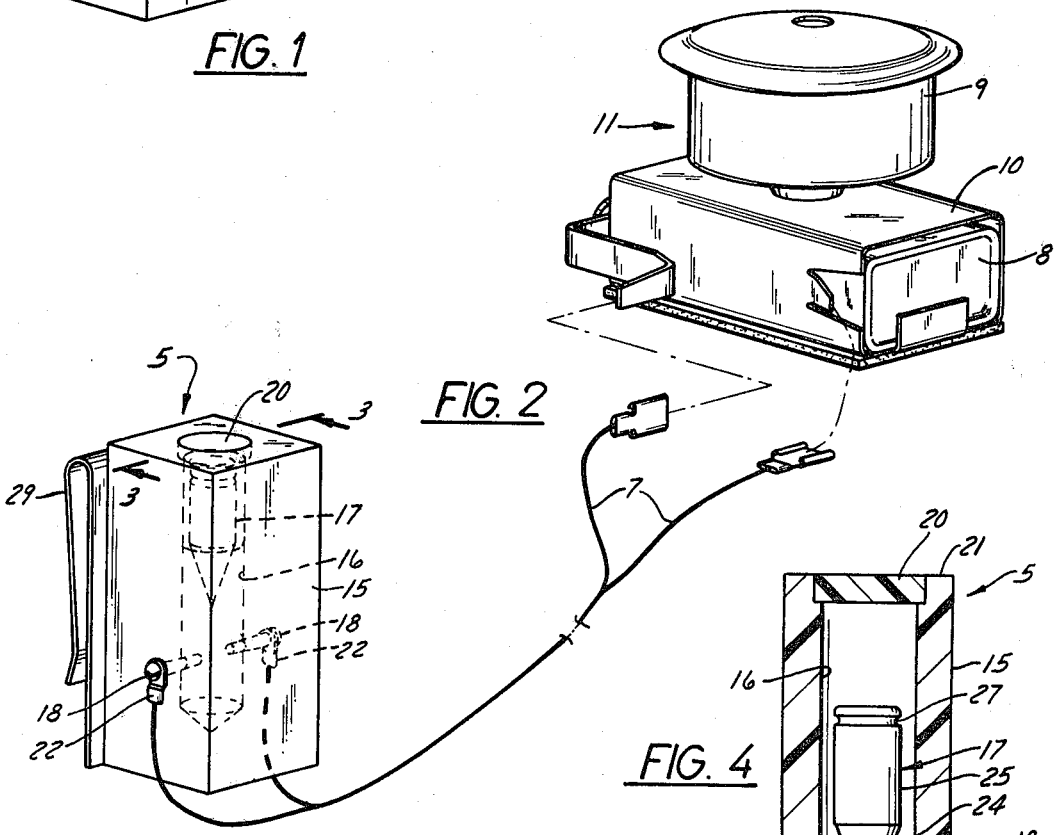
FIG. 2 is a perspective view on an enlarged scale of the components comprising the alarm system.

When the material 26 is frozen, the sensor can be "armed" by reorienting it to have the contactors 19 lowermost and the slider 17 uppermost, its orientation and condition then being the normal one shown in FIG. 3. As long as normally cold temperatures prevail in the freezer cabinet interior, the frozen material will hold the slider 17 spaced above the contactors 19 and thus out of contact with them. Temperatures above the critical value that are maintained only briefly, as upon opening of the cabinet door or during an automatic defrost cycle, will not normally melt the material 26. However, if the temperature remains above the critical value for a significant length of time, the material 26 melts, releasing the slider 17 to fall down to its circuit making position in engagement with the contactors 19, as shown in FIG. 4, thus, energizing the alarm circuit in which the sensor is connected.

It will be apparent that the material 26 can be selected to provide whatever temperature response characteristics are desired for the sensor. In the case of a freezer alarm sensor, the material 26 can be a mixture of water and potable alcohol, proportioned for the desired melting temperature. Such a mixture, in addition to being non-toxic and non-contaminating, does not interfere with flow of current between the contactors 19 and the slider 17 if it is present as a film on those parts.

A hook 29 can be attached to the body 15 to enable the sensor to be hung on a shelf or bracket in a freezer cabinet. Preferably the hook 29 has a swivel connection to the body 15 so that the body can be oriented with either end uppermost when the sensor is suspended by the hook.

Figure 5:
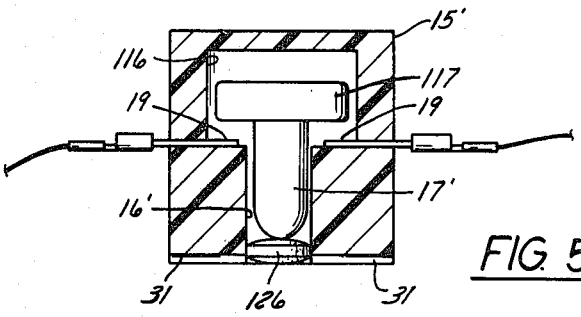
FIG. 5 is a view in vertical section of another embodiment of the invention, suitable for sensing the presence of water or high heat.
Figure 6:
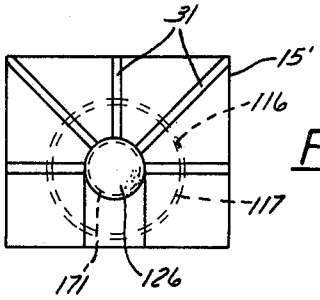
FIG. 6 is a bottom view of the sensor shown in FIG. 5.

The principles of this invention are also applicable with slight modification to sensors for other deleterious conditions, as illustrated in FIGS. 5 and 6, which depict a sensor that can trigger an alarm system to detect the presence of water. In this case the body 15' of the sensor has a well 16' that opens to its bottom, and the slider 17' which is guided for up and down motion in that well is substantially mushroom shaped, having an enlarged diameter head 117 that comprises its contactor portion. The head 117 of the slider is located in an upper enlarged diameter portion 116 of the well 16'. The stationary contactors 19 are exposed in the enlarged diameter portion 116 of the well at opposite sides of the well axis, and they face upwardly to be bridged and electrically connected by the head 116 of the slider when the slider 16' is in a dropped position.

Normally, however, the slider 16' is maintained in a raised position, out of engagement with the contactors 19, by means of a pellet 126 which is located in the bottom of the well and upon which the slider rests. In the case of a water or flood alarm sensor the pellet can be of a normally solid material such as aspirin that readily dissolves or disintegrates when exposed to water. Grooves 31 in the bottom surface of the body 15', extending between the outer edges of that surface and the well, ensure that any water near the sensor will be able to flow into contact with the pellet.

For a high temperature sensor the pellet 126 can be of a suitable wax or the like that melts upon attaining a temperature at which the alarm is to be triggered.

It will be observed that the pellet 126, in being located below the level of the contactors 19, cannot leave any electrically insulating deposit or coating on those contactors when it melts or disintegrates, thus ensuring reliable operation of the sensor.

From the foregoing description taken with the accompanying drawings it will be apparent that this invention provides a very dependable but inexpensive sensor which is responsive to a deleterious condition, and in one particularly advantageous embodiment provides an overtemperature alarm sensor for food freezers that is self-contained, capable of indefinitely repeated re-use, inexpensive, and capable of closing an energizing circuit for an alarm device without need for a supplementary amplifier.

What I claim is:

1. A sensor for connecting an electrically operated alarm signaling device in an energizing circuit in response to existence of a deleterious condition, characterized by:

A. a body in which there is a well that has top and bottom ends and which can be supported with the axis of said well extending substantially vertically;

B. a pair of contact elements fixed to said body, normally insulated from one another and connectable in an electrical energizing circuit, said contact elements comprising a pair of opposing contacts exposed in said well at a location spaced from both of said ends thereof, said contacts being at opposite sides of the axis of the well and spaced apart by a distance less than the diameter of the well at said location;

C. a gravity actuated slider having (1) a substantially cylindrical body portion that is guided by the well for up and down motion therein relative to the body and comprises a substantial portion of the mass of the slider, and (2) a substantially concentric contact portion which, in a normal position of the slider, is spaced from said contacts in the direction towards the top end of the well, said contact portion tapering in the opposite direction to wedgingly engage said contacts and provide a good electrical connection between them when the slider falls from its normal position towards the bottom end of the well; and D. said body and said slider being arranged for cooperation with a quantity of material which is normally solid and which engages the slider to support it in its normal position, said material being capable of disintegrating in the presence of said deleterious condition to release the slider for fall from its normal position.

2. The sensor of claim 1, wherein said well has a uniform diameter along substantially its entire length and said cylindrical portion of the slider has a slightly smaller diameter than the well to provide a clearance space between the body and the slider, further characterized by:

E. said cylindrical portion of the slider having a radially outwardly opening recess therein in which said material in its solid state can engage to bind the slider against axial motion.

3. The sensor of claim 2 wherein said recess in the cylindrical portion of the slider is defined by a circumferential groove around it.

4. The sensor of claim 1 wherein said well has a uniform diameter along substantially its entire length, said cylindrical portion of the slider has a slightly smaller diameter than the well to provide a clearance space between the body and the slider, and said substantially cylindrical body portion of the slider is nearer the top end of the well than said contact portion and the contacts.

5. The sensor of claim 1 wherein the well in said body is closed at its top and bottom ends to confine said material therein and said material is in liquid state in the presence of said deleterious condition, further characterized by:

E. the quantity of said material in said well being such that with the body oriented to have the bottom of the well lowermost, the level of said material in its liquid state is below said opposing contacts.

6. An overtemperature sensor for closing an electrical energizing circuit for an alarm signal device when temperature at the sensor rises above a predetermined value, said sensor comprising:

A. a body in which there is an elongated chamber, said body having means on its exterior for maintaining it in either selected one of two substantially opposite orientations in each of which said chamber extends lengthwise substantially vertically;

B. stationary switch elements on said body comprising a pair of contacts, which are (1) normally insulated from one another, (2) connectable in an energizing circuit and (3) exposed in said chamber at opposite sides thereof, axially spaced from the ends of said chamber and laterally spaced from one another;

C. a gravity actuated contactor slidable in said chamber between a normal position at one end of said chamber, spaced from said contacts, and a dropped position engaged with said contacts to electrically connect them with one another, said contactor having (1) a substantially cylindrical portion which is remote from said contacts and wherein there is a radially outwardly opening recess, and (2) a substantially conical current conducting portion nearer said contacts and which tapers towards said contacts to be wedgingly engageable with them for good electrical connection; and D. a quantity of material in said chamber that is solid at temperatures below said value and can engage in said recess to bind the contactor in its normal position, said material being liquid at temperatures above said value for releasing said contactor for fall to its dropped position.

7. The overtemperature sensor of claim 6 wherein the quantity of said material is such that when said material is liquid and said contactor is in its dropped condition, said material is substantially wholly below said pair of contacts.

* * * * *